US007850791B2

(12) United States Patent
Quadakkers

(10) Patent No.: US 7,850,791 B2
(45) Date of Patent: Dec. 14, 2010

(54) PROTECTIVE LAYER FOR AN ALUMINUM-CONTAINING ALLOY FOR HIGH-TEMPERATURE USE

(75) Inventor: Willem J. Quadakkers, Wijnandsrade (NL)

(73) Assignee: Forschungszentrum Julich GmbH, Julich (DE)

( * ) Notice: Subject to any disclaimer, the term of this patent is extended or adjusted under 35 U.S.C. 154(b) by 606 days.

(21) Appl. No.: 10/586,089

(22) PCT Filed: Nov. 20, 2004

(86) PCT No.: PCT/DE2004/002570

§ 371 (c)(1),
(2), (4) Date: Jul. 13, 2006

(87) PCT Pub. No.: WO2005/071132

PCT Pub. Date: Aug. 4, 2005

(65) Prior Publication Data

US 2008/0245446 A1 Oct. 9, 2008

(30) Foreign Application Priority Data

Jan. 21, 2004 (DE) ..... 10 2004 002 946

(51) Int. Cl.

| | |
|---|---|
| ***C23C 8/10*** | (2006.01) |
| ***C23C 8/00*** | (2006.01) |
| ***C23C 22/00*** | (2006.01) |
| ***B05D 3/02*** | (2006.01) |

(52) U.S. Cl. ..... 148/285; 148/240; 148/284; 148/286; 148/287; 427/372.2

(58) Field of Classification Search ..... 148/240, 148/284–287; 427/372.2

See application file for complete search history.

(56) References Cited

U.S. PATENT DOCUMENTS

| | | | | |
|---|---|---|---|---|
| 5,741,372 | A * | 4/1998 | Gugel | 148/276 |
| 6,599,636 | B1 * | 7/2003 | Alger | 428/472 |

FOREIGN PATENT DOCUMENTS

| | | |
|---|---|---|
| JP | 7144972 | 11/1993 |
| JP | 11253815 | 9/1999 |
| RU | 1 824 234 | 6/1993 |

OTHER PUBLICATIONS

Joseph R. Davis, ASM Handbook-Chromate Coatings On Specific Metals, 1992, ASM International, 9th Edition, vol. 13, 394.*

* cited by examiner

*Primary Examiner*—Roy King
*Assistant Examiner*—Caitlin Fogarty
(74) *Attorney, Agent, or Firm*—Jonathan Myers

(57) ABSTRACT

Alloys containing aluminium are characterised by an outstanding oxidation resistance at high temperatures, that is based on, inter alia, the formation of a thick and slow-growing aluminium oxide layer on material surfaces. If the formation of the aluminium oxide layer reduces the aluminium content of the alloy so far that a critical aluminium concentration is not reached, no other protective aluminium oxide layer can be formed. This leads disadvantageously to a very rapid breakaway oxidation, and the destruction of the component. This effect is stronger at temperatures above 800° C. due to the fact that, often at this point, metastable $Al_2O_3$ modifications, especially θ- or γ-$Al_2O_3$, are formed instead of α-$Al_2O_3$ that is generally formed at high temperatures. The above-mentioned oxide modifications are disadvantageously characterised by significantly higher growth rates. The invention relates to methods whereby aluminium-containing alloys advantageously form an oxidic covering layer predominantly consisting of α-$Al_2O_3$, at a temperature higher than 800° C., especially in the initial stage of oxidation, and thus have a significantly improved long-term behaviour.

10 Claims, No Drawings

PROTECTIVE LAYER FOR AN ALUMINUM-CONTAINING ALLOY FOR HIGH-TEMPERATURE USE

CROSS REFERENCE TO RELATED APPLICATIONS

This application is the US national phase of PCT application PCT/DE2004/002570, filed 20 Nov. 2004, published 4 Aug. 2005 as WO2005/071132, and claiming the priority of German patent application 102004002946.6 itself filed 21 Jan. 2004, whose entire disclosures are herewith incorporated by reference.

FIELD OF THE INVENTION

The invention relates to a protective layer for an aluminum-containing alloy for high-temperature use, in particular at temperatures up to 1400° C. The invention further relates to a method of producing such a protective layer on aluminum-containing alloys.

PRIOR ART

Alloys based on Fe—Al, Mi—Al, Ni—Cr—Al or Fe—Cr—Al are characterized by an excellent oxidation resistance at very high operating temperatures (≈1400° C.). Alloys based on Fe—Al, Mi—Al, Ni—Cr—Al or Fe—Cr—Al are characterized by excellent oxidation resistance at very high operating temperatures (≈1400° C.). This resistance is due to the formation of a thick and slowly growing aluminum oxide layer, which forms with high temperature application on work surfaces (alloys). This protective cover layer, which is caused by selective oxidation of the alloying element aluminum, only occurs when the aluminum content in the alloy is sufficiently large, e.g., at least about 8% by weight in Fe—Al or Ni—Al alloys, and at least about 3% by weight in Fe—Cr—Al or Ni—Cr—AL alloys.

Due to the formation of the cover layer of aluminum oxide, the alloying element present in the aluminum alloy is used up. The use per time unit is generally proportional to the oxide growth rate, and thus increases with increasing temperature, since the oxide growth rate (k in $cm^2$ per second} increases with increasing temperature. The aluminum reservoir present as a whole in an aluminum-containing alloy increases proportionally with the wall thickness of a relevant component. When the component is a layer or foil, the strength typically is proportional to the thickness of the layer, and when the component is a wire, for example to the diameter.

If due to long-term application of a component consisting of an aluminum-containing alloy and the formation of an aluminum oxide layer on its surface, the aluminum content of the alloy is reduced to such an extent that it falls below a critical aluminum concentration, then a further protecting aluminum oxide layer can no longer form. This results in very quick "breakaway oxidation." This time matches the so-called end of life of the components.

It follows from the above considerations that the life of a component declines either with increasing oxide growth rate or decreasing wall thickness.

Some examples of typical remaining-life times ($t_B$) of components consisting of FeCrAl alloys (commercial names, e.g., KANHAL AF or ALUCHROM YHF) varying with the temperature and wall thickness are known from the literature. For instance, for a 1 mm wall thickness at 1200° C., about 10,000 h, for a 0.05 mm wall thickness at 1100° C., about 700 h, for a 0.05 mm wall thickness at 1200° C., about 80 h.

Theoretical considerations allow the inference that with a 100° C. temperature increase, the life span decreases by about a factor of 10. The $t_B$ temperature dependence follows from the known temperature dependence of the oxide growth rate k, which is defined as follows:

$$k=k_0\,e^{-Q/RT}$$

where Q=the activation energy for diffusion processes in the layer, T=temperature, and R=general gas constant. The remaining-life time ($t_B$) dependence of the component wall strength (d) can be stated for most applications approximately like this:

$t_B$ proportional to $d^3$.

This illustrates the strong reduction of the remaining-life time, when component wall strength is reduced. For very thin-walled components consisting of the above-mentioned alloys, as are present, e.g. in car-catalyst substrates (foil thicknesses 0.02 to 0.1 mm), in fiber-based gas burners, or filters (fiber diameter 0.015 to 0.1 mm), operating times of a few thousand hours as are required in practice are only possible if the operating temperatures are kept relatively low, e.g. around 900° C.

However, in this temperature range, especially between 800 and 950° C., the growth rate (k) of the oxide layer disadvantageously exhibits a distinct variance from the above-mentioned temperature dependence. This difference occurs especially in the initial stage (e.g. up to approximately 100 h) of oxidation stress. This variance is due to the fact that at temperatures about 800° C., the $\alpha$-$Al_2O_3$ formed at high temperatures (at and above 1000° C.) (hexagonal structure; corundum lattice) does not occur, whereas metastable $Al_2O_3$ modifications, especially $\theta$- or $\gamma$-$Al_2O_3$ do. These oxide modifications are characterized by significantly higher growth rates than has $\alpha$-$Al_2O_3$. They generally occur only in the initial stages of oxidation. After long periods, transition to stable $\alpha$-$Al_2O_3$ with corresponding low growth rates occur.

The life span of a component at 900° C. therefore cannot generally be extrapolated from the oxide growth rates known at higher temperatures. For thick-walled components with a wall thickness of 1 to 2 mm, for example, this is generally not a problem, since the aluminum reservoir in the alloy is sufficiently high that the initial high growth rate at temperatures around 900° C., due to the metastable oxide modifications, does not result in a significant reduction of the total aluminum reservoir.

However, for very thin components, e.g. 0.003 to 0.1 mm thin foils, because of the initial high growth rate of the oxide layer, the existing very small aluminum reservoir may be exhausted disadvantageously even within a few hours. This regularly causes complete destruction of the components. The actual life span is therefore less by orders of magnitudes, as could be expected from the extrapolation of the growth rates of the $\alpha$-$Al_2O_3$ layers at high temperatures (1000 to 1200° C.). The above-mentioned alloys are therefore not suitable for application in the afore-mentioned thin-walled components, e.g. car catalysts, gas burners or filter systems.

OBJECT AND SOLUTION

The object of the invention is to provide a method, whereby aluminum-containing alloys form an oxide cover layer substantially composed of $\alpha$-$Al_2O_3$ when applying a temperature exceeding 800° C., especially in the initial phase of oxidation, thereby exhibiting clearly improved long-term behavior.

Subject of the Invention

Within the scope of the invention, it was found that surface treatment of aluminum-exhibiting alloys based on Fe—Al—, Ni—Al, Ni—Cr—Al and Fe—Cr—Al causes improved long-term stability, when using these alloys at temperatures at which metastable $Al_2O_3$ modifications appear. This surface treatment advantageously causes regular inhibition of the formation of metastable Al-oxides under subsequent operational application at higher temperatures around 900° C., especially in the temperature range of 800 to 950° C.

The process according to the invention is based on the fact that the presence of other, i.e. non-aluminum-containing oxides on the surface of an aluminum-containing alloy, or a similar component, promotes the formation of the advantageous $\alpha$-$Al_2O_3$ at operating temperatures above 800° C. Thus, the disadvantageous formation of metastable $Al_2O_3$ modifications, such as $\theta$- or $\gamma$-$Al_2O_3$, is suppressed, whereby the non-aluminum-containing oxides act on the surface of the alloy as nucleating agents promoting especially the formation of the $\alpha$-$Al_2O_3$ modification at temperatures above 800° C. This effect occurs advantageously right at the beginning of the oxidation of the alloy and at operating temperatures, thus regularly preventing the harmful formation of metastable aluminum oxides from the start.

The non-aluminum containing oxides are deposited on the aluminum-containing to form a layer having a maximum thickness of 5000 nm, more especially only 1000 nm, and most especially only 100 nm.

Useful examples of such oxides acting advantageously on the surface are especially Ni oxides, Fe oxides, Cr oxides and Ti oxides. The oxides may be deposited on the surfaces of the components consisting of the said metallic, aluminum-containing alloys or also created by various methods.

These include, especially

- Direct deposition of the aforesaid oxides on the alloy surface, e.g. through vaporization and condensing, or cathode sputtering.
- Direct deposition of a metallic layer consisting of Ti, Cr, Ni or Fe on the surface of an alloy using deposition methods known from prior art. With a high-temperature application of above 800° C., the said metals convert to the desired oxides in an oxygen atmosphere.
- Treatment of the alloy in a chloride- and/or fluoride-containing solution, or a gaseous atmosphere, in which such a solution is present. A Fe-, Ni- or Cr-containing oxide or hydroxide thus forms at the surface of the alloy, depending on the alloy base. With a high-temperature application, the hydroxides convert to their corresponding oxides.
- A temperature treatment of the alloy, whereby a temperature below 800° C. is initially set, [and] whereby preferably the additional alloy elements {except aluminum) form an oxide layer on the surface.

All these methods have in common that initially an oxide layer, which does not substantially consist of an aluminum oxide, forms on the surface of the alloy. Moreover, to get the desired effect of the advantageous formation of an $\alpha$-$Al_2O_3$ layer, or the inhibition of metastable aluminum-oxide layers, it may be sufficient when the surface layer exhibits further, non-aluminum-containing oxides with a concentration of at least 20%, and especially above 50%.

By a surface layer of the alloy is meant a near-surface area with a thickness of up to 1000 nm. Within the scope of the invention, it has emerged that the action of the non-aluminum-containing oxides on the surface of the alloy already occurs with a thickness of the layers of only a few nm.

Special Specification Section

The subject of the invention will be explained in more detail in reference to several examples, without limiting the scope of the invention.

A schematic representation of the dependence on temperature of the oxide growth on alloys of the Fe—Al, Fe—Cr—Al, Mi—Al or Ni—Cr—Al type is provided in the FIGURE.

The dashed lines indicate the thickness of an oxide layer formed on the surface of a corresponding alloy with exclusive formation of $\alpha$-$Al_2O_3$ at the corresponding temperatures versus time (both in arbitrary units). After an initial somewhat steeper gradient of the growth rate, it then remains almost constant causing an almost linear increase of the thickness of the layer over longer periods. Altogether, the formed thickness of the layer increases, when the relevant operating temperature decreases.

Moreover, for a temperature of 900° C., indicated by a continuous line, the thickness of the layer at the initial formation of metastable aluminum oxides and subsequent formation of $\alpha$-$Al_2O_3$ is indicated. The comparison highlights the distinctly higher growth rate of the metastable aluminum oxides, precisely in the initial stage. During the further process, the growth rate remains almost constant, so that over time, an almost linearly increasing thickness of the layer forms.

As treatment methods for obtaining the advantageous non-aluminum-containing oxides on the surface of aluminum-containing alloys, the methods described in the following have proven especially effective:

1. A Ni oxide, Fe oxide, Cr oxide or Ti oxide is deposited during vaporization and condensation on the surface of a component consisting of an aluminum-containing alloy with a preferred thickness of 5 to 1000 nm. This deposition method is thus equivalent to the prior art.

2. On the surface of a component consisting of an aluminum-containing alloy, a metallic layer consisting of Fe, Ni, Cr or Ti is initially deposited to get a thickness of 5 to 1000 nm by common deposition methods. As suitable deposition methods, especially vaporization and condensing, cathode sputtering, galvanic coating may be mentioned. For operational application, i.e. at temperatures above 800° C., these metals convert to the corresponding oxides in an oxygen atmosphere.

3. A component consisting of an aluminum-containing alloy is treated in a chloride- and/or fluoride-containing solution, or in a gaseous atmosphere, in which such a solution is present. A suitable solution is, for example, a 10% NaCl solution in water. This treatment is done at room temperature, or at a slightly increased temperature of about 80° C. During this treatment, which is done over a period of a few minutes and up to two hours, a Fe- or Ni-containing oxide and/or hydroxide forms at the surface of the component, depending on the alloy base. With subsequent high-temperature application, the possibly present hydroxide converts to the desired Fe oxide ($Fe_2O_3$] or Ni oxide (NiO).

4. A component is initially exposed to a temperature of 750° C. for a period of a few minutes up to five hours, whereby a Fe- or Ni-containing oxide forms on the surface depending on the alloy base.

The invention claimed is:

1. A method for preparing a stable $\alpha$-aluminum oxide protective layer for (i) an aluminum-containing alloy foil Fe—Al or Ni—Al having a thickness of 0.003 to 0.1 mm and an Al content of at least 8% by weight or for (ii) an aluminum-containing alloy foil Fe—Cr—Al or Ni—Cr—Al having a thickness of 0.003 to 0.1 mm and an Al content of at least 3% by weight, the method comprising the steps of:

(a) depositing Ni, Fe, Cr or Ti on the surface of the aluminum-containing alloy foil (i) or (ii) in an oxygen atmosphere to form on the aluminum-containing alloy foil, an oxide layer of a non-aluminum-containing oxide having a thickness of up to 1000 nm effective to suppress formation of metastable forms of aluminum oxide; and (b) heating the aluminum-containing alloy foil (i) or (ii) on which is formed an oxide layer of a non-aluminum-containing oxide to a temperature of at least 800° C., whereby the oxide layer of the non-aluminum-containing oxide acts on the surface of the aluminum-containing alloy foil (i) or (ii) as a nucleating agent to promote formation of the stable α-aluminum oxide while suppressing formation of metastable forms of aluminum oxide.

2. The method according to claim 1 wherein according to step (b) the aluminum-containing alloy foil (i) or (ii) is heated to a temperature of 800 to 950° C.

3. The method according to claim 1 wherein the non-aluminum containing oxide layer has a maximum thickness of 100 nm.

4. The method according to claim 1 wherein according to step (a) the deposition is realized by vaporization and condensing or by cathode sputtering.

5. The method according to claim 1 wherein according to step (a) the deposition is carried out through vaporization and condensing, cathode sputtering or galvanic deposition.

6. A method for preparing a stable α-aluminum oxide protective layer for (i) an aluminum-containing alloy foil Fe—Al or Ni—Al having a thickness of 0.003 to 0.1 mm and an Al content of at least 8% by weight or for (ii) an aluminum-containing alloy foil Fe—Cr—Al or Ni—Cr—Al having a thickness of 0.003 to 0.1 mm and an Al content of at least 3% by weight, the method comprising the steps of:

(a) treating the aluminum-containing alloy foil (i) or (ii) in a chloride- or fluoride-containing medium, to selectively oxidize the Fe, Ni or Cr in the aluminum-containing alloy foil (i) or (ii) to form on the surface of the aluminum-containing alloy foil (i) or (ii), an oxide layer of a non-aluminum-containing oxide having a thickness of up to 1000 nm effective to suppress formation of metastable forms of aluminum oxide wherein the non-aluminum-containing oxide is iron oxide, nickel oxide or chromium oxide; and;

(b) heating the aluminum-containing alloy foil (i) or (ii) on which is formed an oxide layer of a non-aluminum-containing oxide to a temperature of at least 800° C., whereby the oxide layer of the non-aluminum-containing oxide acts on the surface of the aluminum-containing alloy foil (i) or (ii) as a nucleating agent to promote formation of the stable α-aluminum oxide while suppressing formation of metastable forms of aluminum oxide.

7. The method according to claim 6 wherein according to step (a) the aluminum-containing alloy foil (i) or (ii) is treated by introducing said alloy foil (i) or (ii) into the chloride- or fluoride-containing medium over a period of one minute to five hours.

8. The method according to claim 6 wherein according to step (a) the aluminum-containing alloy foil (i) or (ii) is introduced into the chloride- or fluoride-containing medium at temperatures between 30° and 100° C.

9. A method for preparing a stable α-aluminum oxide protective layer for (i) an aluminum-containing alloy foil Fe—Al or Ni—Al having a thickness of 0.003 to 0.1 mm and an Al content of at least about 8% by weight or for (ii) an aluminum-containing alloy foil Fe—Cr—Al or Ni—Cr—Al having a thickness of 0.003 to 0.1 mm and an Al content of at least about 3% by weight, the method comprising the steps of:

(a) heating the aluminum-containing alloy foil (i) or (ii) to a temperature below 800° C. to selectively oxidize the Fe, Ni or Cr in the aluminum-containing alloy foil (i) or (ii) to form on the surface of the aluminum-containing alloy foil (i) or (ii), an oxide layer of a non-aluminum-containing oxide having a thickness of up to 1000 nm effective to suppress formation of metastable forms of aluminum oxide wherein the non-aluminum-containing oxide is iron oxide, nickel oxide or chromium oxide; and (b) heating the aluminum-containing alloy foil (i) or (ii) on which is formed an oxide layer of a non-aluminum-containing oxide to a temperature of at least 800° C., whereby the oxide layer of the non-aluminum-containing oxide acts on the surface of the aluminum-containing alloy foil (i) or (ii) as a nucleating agent to promote formation of the stable alpha-aluminum oxide while suppressing formation of metastable forms of aluminum oxide.

10. The method according to claim 9 wherein according to step (a) the aluminum-containing alloy foil (i) or (ii) is heated to a temperature of 750° C.

* * * * *